US008667923B2

(12) United States Patent
Claris

(10) Patent No.: US 8,667,923 B2
(45) Date of Patent: Mar. 11, 2014

(54) WATER FEED DEVICE FOR AN INCLINED MOISTENER IN A MAIL HANDLING MACHINE

(75) Inventor: Yannick Claris, Fontenay Aux Roses (FR)

(73) Assignee: Neopost Technologies, Bagneux (FR)

( * ) Notice: Subject to any disclaimer, the term of this patent is extended or adjusted under 35 U.S.C. 154(b) by 1709 days.

(21) Appl. No.: 11/965,068

(22) Filed: Dec. 27, 2007

(65) Prior Publication Data

US 2008/0163981 A1 Jul. 10, 2008

(30) Foreign Application Priority Data

Dec. 27, 2006 (FR) ..... 06 55977

(51) Int. Cl.
*B05C 11/00* (2006.01)
*B43M 3/00* (2006.01)

(52) U.S. Cl.
USPC ..... 118/264; 118/200; 427/429; 156/441.5; 156/442.1

(58) Field of Classification Search
USPC ..... 118/264, 267, 268; 156/441.5
See application file for complete search history.

(56) References Cited

U.S. PATENT DOCUMENTS

| | | | | |
|---|---|---|---|---|
| 2,243,536 | A * | 5/1941 | Rouan et al. | 137/118.01 |
| 4,924,271 | A * | 5/1990 | Brinton et al. | 399/325 |
| 5,006,194 | A * | 4/1991 | Schmaling | 156/442.1 |
| 5,354,379 | A * | 10/1994 | Milbourn et al. | 118/696 |
| 5,807,463 | A * | 9/1998 | Boughton | 156/441.5 |
| 6,346,149 | B1 * | 2/2002 | Gregoire et al. | 118/264 |
| 6,808,594 | B2 * | 10/2004 | Supron et al. | 156/441.5 |
| 7,067,036 | B2 * | 6/2006 | Beckstrom | 156/441.5 |
| 7,364,621 | B2 * | 4/2008 | Defosse et al. | 118/264 |

FOREIGN PATENT DOCUMENTS

| | | |
|---|---|---|
| EP | 1 640 178 A1 | 3/2006 |
| GB | 2 259 295 A | 3/1993 |

* cited by examiner

*Primary Examiner* — Dah-Wei Yuan
*Assistant Examiner* — Karl Kurple
(74) *Attorney, Agent, or Firm* — Sughrue Mion, PLLC

(57) ABSTRACT

A water feed device for feeding water to a moistener for moistening envelope flaps that is incorporated into a mail handling machine, the water feed device comprising a reserve stock of water from which a quantity of water flows to a reservoir of water, said quantity of water being suitable for imbibing a piece of foam dipping in said reservoir of water, said device having at least two distinct water feed circuits for feeding water separately to two separate compartments of the reservoir of water from two isolated compartments of the reserve stock of water in a manner such as to define two distinct levels of water for the two isolated compartments of the reserve of water, and thus to define two different heights of water in the two corresponding separate compartments of the reservoir of water.

4 Claims, 1 Drawing Sheet

WATER FEED DEVICE FOR AN INCLINED MOISTENER IN A MAIL HANDLING MACHINE

FIELD OF THE INVENTION

The present invention relates exclusively to the field of mail handling, and it relates more particularly to a water feed device for feeding water to a moistener for moistening envelope flaps that is incorporated into a mail handling machine.

PRIOR ART

Devices making it possible to feed water to moisteners in mail handling machines are well known, and conventionally such a device comprises a reserve stock of water mounted on a support and connected to a reservoir of water which is disposed under a conveyor table for conveying the envelopes, and in which a piece of foam dips in part. The envelopes are moistened as the flaps of the envelopes pass between the top surface of the moistened piece of foam and a brush placed immediately behind a separator for separating the flaps from the bodies of the envelopes.

Unfortunately, such a water feed device suffers from certain drawbacks. Such a device, which does not use any pumping means, has a single water-quantity setting that, by definition, cannot be adapted to all of the available types of envelope. As a result, the quality of sticking down is degraded for certain types of envelope. But above all, when the conveyor table is inclined towards a referencing wall, the moistener, which operates on the principle of communicating vessels, is not imbibed uniformly, and the flap of the envelope is thus not moistened uniformly over its width. In particular, if the level of water is defined so as to moisten properly the portion of the flap that is close to where it meets the body of the envelope, then the free portion or tip of the flap is not moistened correctly. Conversely, if the level of water is defined to moisten properly the tip of the flap, then the portion of the flap that is close to where it meets the body of the envelope is moistened abundantly, giving rise to water being deposited on the print rollers and then on the print zone, resulting in the postage imprint bleeding.

OBJECT AND DEFINITION OF THE INVENTION

The present invention thus proposes a water feed device that mitigates those drawbacks and that makes it possible, in particular, to vary the quantity of water deposited depending on the shape and, in particular, on the width of the flaps. An object of the invention is to implement such a device without significantly modifying the current structure of mail handling machines.

These objects are achieved by a water feed device for feeding water to a moistener for moistening envelope flaps that is incorporated into a mail handling machine, the water feed device comprising a reserve stock of water from which a quantity of water flows to a reservoir of water, said quantity of water being suitable for imbibing a piece of foam dipping in said reservoir of water, said water feed device having at least two distinct water feed circuits for feeding water separately to at least two separate compartments of said reservoir of water from at least two isolated compartments of said reserve stock of water in a manner such as to define at least two distinct levels of water for the at least two isolated compartments of said reserve of water, and thus to define at least two different heights of water in the at least two corresponding separate compartments of said reservoir of water.

Thus, with this particular configuration, the quantity of water deposited on the flap of the envelope varies over the width of said envelope, thereby making it possible for the entire flap to be moistened uniformly.

Advantageously, said at least two separate compartments of said reservoir of water are disposed adjacently over the width of the flap and are separated by at least one longitudinal wall.

Preferably, said reserve of water is mounted on a compartmented support provided with at least two mutually independent shut-off valves that define two separate paths along which the water can flow from said reserve stock of water.

Advantageously, each of said shut-off valves extends to a respective depth into the isolated compartment of the support that it shuts off in the manner of a stopper and that has a low level defining an equilibrium level for the water flowing from said reserve stock of water through said shut-off valve.

BRIEF DESCRIPTION OF THE DRAWING

The characteristics and advantages of the present invention appear more clearly from the following description given by way of non-limiting indication and with reference to the accompanying drawing, in which.

DETAILED DESCRIPTION OF A PREFERRED EMBODIMENT

Figure 2:
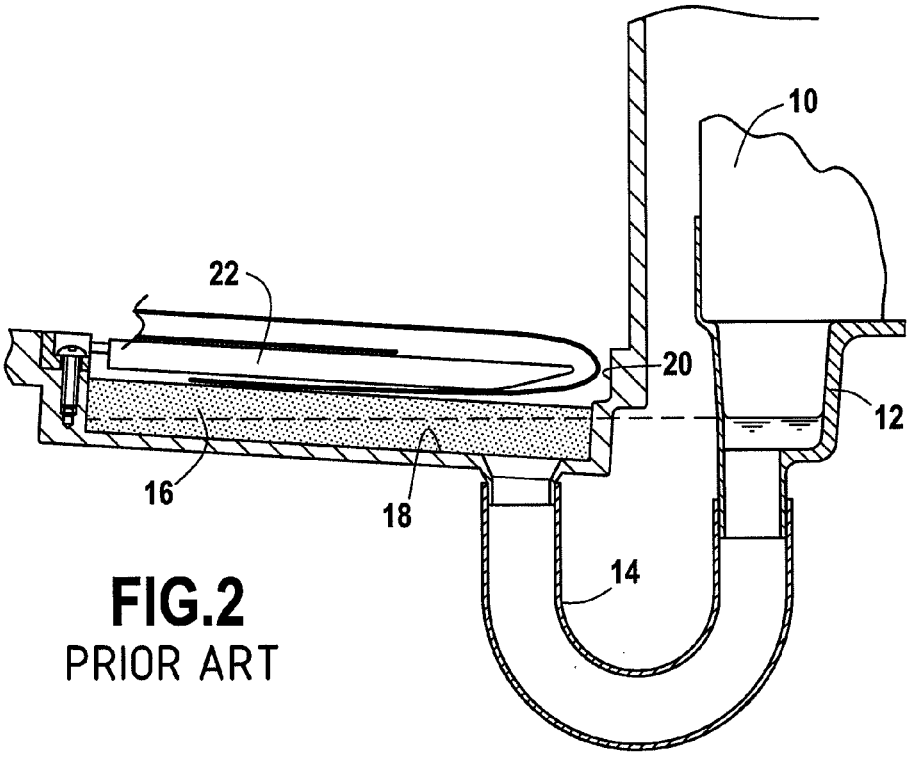
FIG.2 PRIOR ART
FIG. 2 is a cross-section view of a prior art water feed device.

As shown in FIG. 2, a known feed device for feeding a moistening liquid to a moistener in a mail handling machine comprises a reserve stock of a moistening liquid 10 (preferably water) mounted on a support 12 and from which a quantity of moistening liquid flows through a delivery duct 14 for the purpose of imbibing a piece of foam or sponge 16 dipping in a reservoir of liquid 18 disposed under a conveyor table forming a support surface for the envelopes as they are conveyed through the mail handling machine. The conveyor table and the reservoir of liquid are inclined at an angle lying in the range 5° to 20°, and typically 6°, towards a referencing wall 20 for putting the envelopes into a reference position. The envelope flaps are moistened as they pass between the top surface of the foam imbibed with moistening liquid and a hinged brush behind (relative to the direction in which the envelopes advance) a separator 22 designed to separate the flap of each envelope from the body of said envelope. The reserve stock of moistening liquid 10 is easy to remove from its support 12 and can be replaced when the moistening liquid runs short.

Since operation of the device is governed by the principle of communicating vessels, and since the water reaches equilibrium in the horizontal plane, the inclination of the conveyor surface for conveying the envelopes obligatorily gives rise to the foam being imbibed differently over the width of said conveyor surface (see, in dashed lines, the level of water in the foam), thereby giving rise to non-uniform moistening of the flaps, in particular of the widest flaps.

Figure 1:
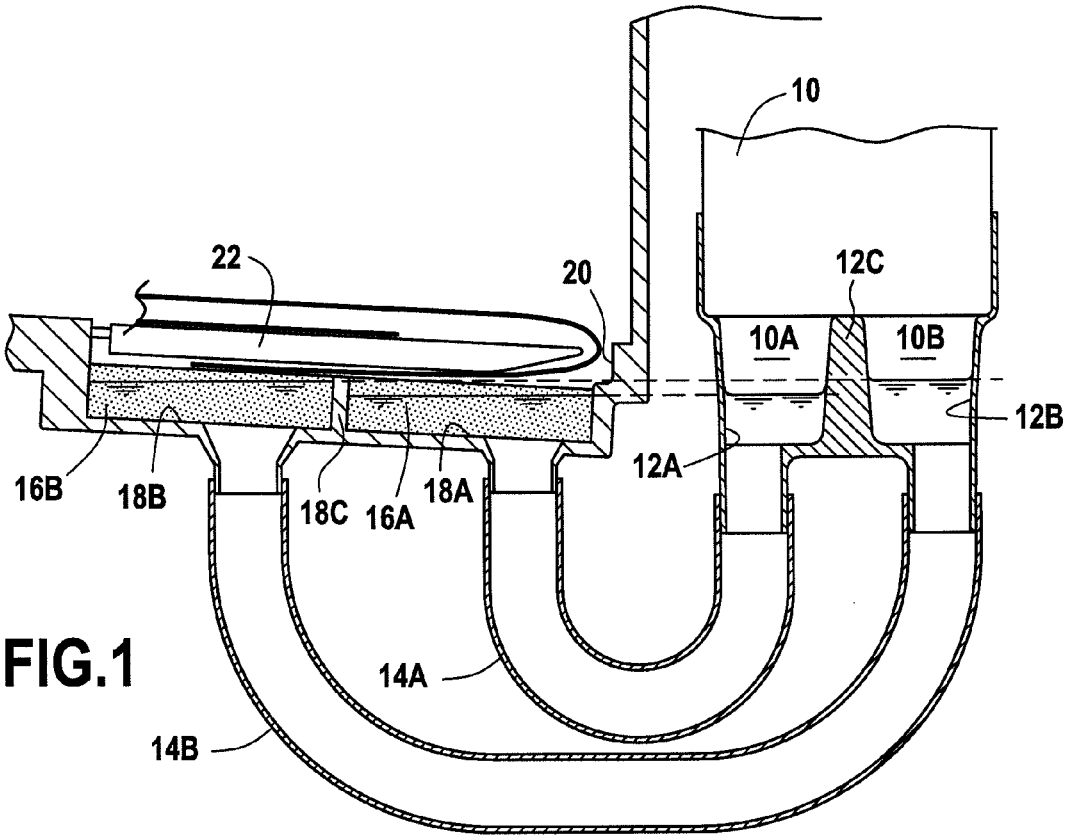
FIG. 1 is a cross-section view of a water feed device of the invention for feeding water to a moistener in a mail handling machine.

In accordance with the invention, and as shown in FIG. 1, in order to achieve uniform moistening, in particular of wide flaps, e.g. flaps that are of the triangular type, it is proposed to distribute the foam in at least two independent compartments

18A, 18B that are adjacent over the width of the flap. These two compartments are isolated from each other by a longitudinal wall 18C, and they are fed separately from respective ones of two delivery ducts 14A, 14B that are also separated from each other, each duct being connected at one end to the inlet orifice of a respective one of the two compartments and at the other end to a respective one of two outlet orifices in the common reserve stock of water.

The reserve stock of water 10 is mounted on a support 12A, 12B compartmented by a separation wall 12C and is provided with at least two mutually independent shut-off valves 10A, 10B that define two separate paths along which the water can flow towards the respective delivery ducts 14B, 14B leading to the two separate compartments 18A, 18B of the reservoir of water. More precisely, each shut-off valve extends to a respective determined depth into an isolated compartment 12A, 12B of the support that it shuts off in the manner of a stopper, and that has a low level defining an equilibrium level for the water flowing out from the reserve stock of water.

This split water feed thus makes it possible to define two distinct water levels (shown in dashed lines), one for each of the two compartments 12A, 12B of the support, and thus to define two different water heights in each of two corresponding compartments 18A, 18B of the water reservoir. Thus, the quantity of water available at the surface of the foam is more uniform and the resulting moistening is also more uniform. The postage imprint is no longer smudged or illegible, and no longer tends to bleed due to overabundance of water where the flap meets the envelope, as in prior art devices.

Naturally, the invention is not limited to the two-compartment configuration that is described above, and it is possible to imagine increasing the uniformity of moistening by adding additional equilibrium levels for the water by adding additional compartments to the reservoir of water, each of which is fed independently from as many separate compartments of the reserve stock of water.

What is claimed is:

1. A moistening device for moistening an envelope flap of an envelope, the moistening device being incorporated into a mail handling machine, the moistening device comprising:

moistening means for moistening the envelope flap in a uniform manner, said moistening means including:

a reservoir of water having two separate compartments having a moistening material therein, a reserve stock of water from which a quantity of water flows to the reservoir of water, said quantity of water being suitable for imbibing the moistening material, said reserve stock of water having two isolated compartments, two distinct water feed circuits for respectively feeding water separately to the two separate compartments of said reservoir of water from the two isolated compartments of said reserve stock of water in a manner such as to define at least two distinct levels of water in the two isolated compartments of said reserve of water, and thus to define two different heights of water in the at least two corresponding separate compartments of said reservoir of water, wherein the envelope flap is conveyed along the moistening material in the two separate compartments so as to be moistened thereby; and a device for separating the envelope flap from the envelope.

2. The moistening device according to claim 1, wherein said two separate compartments of said reservoir of water are disposed adjacently over the width of the flap and are separated by at least one longitudinal wall.

3. The moistening device according to claim 1, wherein said reserve of water is mounted on a compartmented support provided with two mutually independent shut-off valves that define two separate paths along which the water can flow from said reserve stock of water.

4. The moistening device according to claim 3, wherein each of said shut-off valves extends to a respective depth into the isolated compartment of the support that said shut-off valve shuts off in the manner of a stopper and that said isolated compartment has a low level defining an equilibrium level for the water flowing from said reserve stock of water through said shut-off valve.

* * * * *